US005165757A

United States Patent [19]

Grathoff

[11] Patent Number: 5,165,757

[45] Date of Patent: Nov. 24, 1992

[54] METHOD OF STRIP MINING

[75] Inventor: Hartmut Grathoff, Wendelstein, Fed. Rep. of Germany

[73] Assignee: MAN Gutehoffnungshütte Aktiengesellschaft, Oberhausen, Fed. Rep. of Germany

[21] Appl. No.: 732,641

[22] Filed: Jul. 19, 1991

[30] Foreign Application Priority Data

Sep. 19, 1990 [DE] Fed. Rep. of Germany ..... 4029623

[51] Int. Cl.[5] ..... E21C 47/00; E21C 47/04

[52] U.S. Cl. ..... 299/18; 299/19

[58] Field of Search ..... 299/10, 18, 19, 36; 37/195; 209/655

[56] References Cited

FOREIGN PATENT DOCUMENTS

| | | | |
|---|---|---|---|
| 271932 | 9/1989 | Fed. Rep. of Germany | 299/18 |
| 673734 | 7/1979 | U.S.S.R. | 299/19 |
| 1444520 | 12/1988 | U.S.S.R. | 299/19 |

*Primary Examiner*—David J. Bagnell
*Attorney, Agent, or Firm*—Max Fogiel

[57] ABSTRACT

A method of strip mining coal or other minerals by way of continuous-operation winning equipment with a cylindrical winning tool that excavates strips with a more or less rectangular section. The rectangle is approximately as wide as the tool and no higher than half the tool's diameter as the equipment advances. The equipment is connected by a system of conveyor belts to a loader that deposits the excavated minerals onto a face conveyor. The face conveyor can be shifted more or less parallel to the direction the equipment moves in. A quadrilateral district is exposed as the equipment travels first along one short side, then along one long side, and finally along the other short side. Its tool lifts out a strip of mineral. The equipment turns at each end along an arc of approximately one eighth to one fourth of a circle to end up in a ramp surface that occurs when the tool is lowered and raised. A terraced wall is created by lifting out many strips as the equipment's travel is shifted to the side. The ramps of the various strips combine into one ramp surface with a slope that allows the equipment to travel over it under its own power. Once the wall has been created, the blocks of mineral in the district, which comprise several levels one above another and one adjacent to another, are mined in succession starting with the floor created along with the wall. Each level comprises an equal number of adjacent strips.

7 Claims, 7 Drawing Sheets

FIG. 4
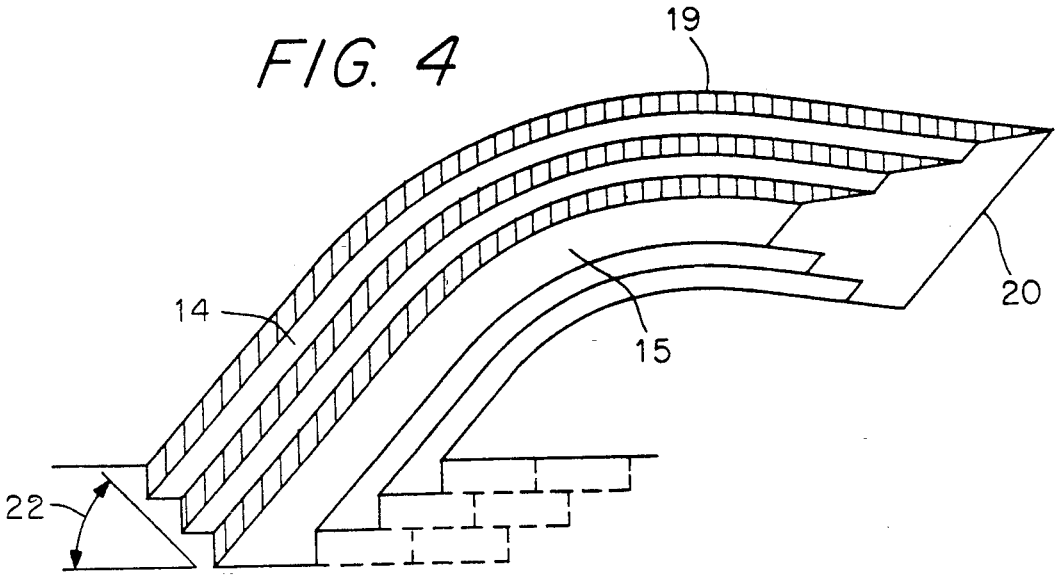
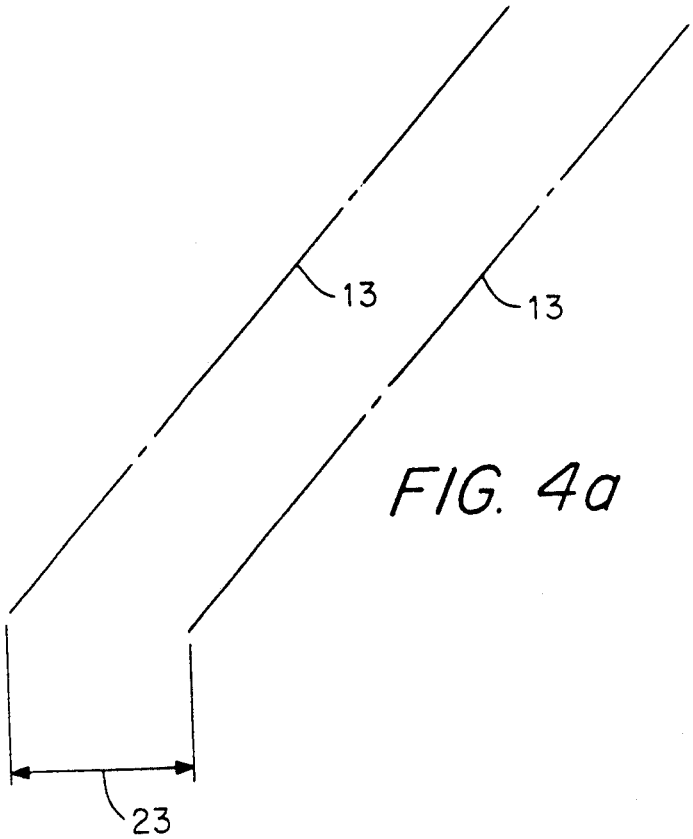
FIG. 4a

METHOD OF STRIP MINING

BACKGROUND OF THE INVENTION

The invention concerns a method of strip mining coal or other minerals by way of continuous-operation winning equipment with a cylindrical winning tool that excavates strips with a more or less rectangular section, whereby the rectangle is approximately as wide as the tool and no higher than half the tool's diameter as the equipment advances and whereby the equipment is connected by a system of conveyor belts to a loader that deposits the excavated minerals onto a face conveyor that can be shifted more or less parallel to the direction the equipment moves in.

Coal is generally strip-mined by removing the overburden with power shovels for example and excavating the deposit with bucket or bucket-chain excavators. Stackers return the spoil, the overburden and the rest of the material that contains no coal, to the coaled-out district.

What are called continuous surface miners have also been employed recently to strip-mine deposits that contain semihard materials. These machines are advanced versions of loaders and ditchers. The material is loosened by the ditching wheel, picked up by shovels, and transferred to webbed-belt conveyors at the rear. Continuous surface miners are mainly employed for hard and brown coal, although they can also be used for bauxite, sand, and clay schist.

The continuous-operation winning equipment recited in the German Application P 3 920 011.6 is of the continuous surface-miner genus.

The object of the invention is to provide a method of strip mining wherein continuous surface miners, especially winning equipment of the type described in the aforesaid German application, can be practically employed. This mining procedure is intended to ensure exploitation of the district as cost-effectively and thoroughly as possible.

SUMMARY OF THE INVENTION

The strip-mining method in accordance with the invention requires no winning equipment, excavators etc. for example, beyond the proposed continuous-operation winning equipment with a cylindrical winning tool. The method results in steep walls on all three sides of the district, ensuring as complete an exploitation as possible.

The district need not be rectangular in practice and can be adapted to the particular geological conditions.

Although arcs at the ends of the individual strips are referred to as measuring an eighth or a quarter of a circle in that claim, they can also be of any dimension when on the same level. The situation is illustrated in FIG. 7. The outermost arc here covers approximately 45° and the innermost arc approximately 90°.

The strip can also extend in a straight line downstream of the arc and upstream of the ramp. The ramp, however, can alternatively be upstream of the end of the arc.

The ramps at the ends of the strips in one block of material should ideally be laid out to provide a single flat surface. In practice, however, deviations from a geometrically ideal plane are permissible to ensure that the undercarriages of the equipment and of any auxiliary equipment will have access to the terrain.

Discontinuities in the ramp surface can be decreased when the arcs of the outer strips on one level are considerably less than 90° for example by slightly tilting the equipment to one side at the end of one demarche and gradually righting it at the beginning of the next demarche.

The individual strips can also be narrower at the ends.

The figures are idealized, representing the strips and blocks of mineral horizontal. In practice, however, the potential for operating the equipment in accordance with the invention tilted to the side will be fully exploited. The removed strips can then be deposited along the borders between the utilizable mineral and the spoil, or parallel thereto. This approach makes it possible to win the strips of mineral selectively.

The strip-mining method in accordance with the invention is naturally not restricted to excavating coal. It can also be employed to mine open-pit deposits of other minerals.

BRIEF DESCRIPTION OF THE DRAWINGS

One embodiment if the method in accordance with the invention will now be specified with reference to the schematic drawing wherein FIG. 4 is a schematic perspective view of a pit once the floor has been established, FIG. 4*a* is a schematic view of a face conveyor before and after being shifted to the side.

Figure 1:
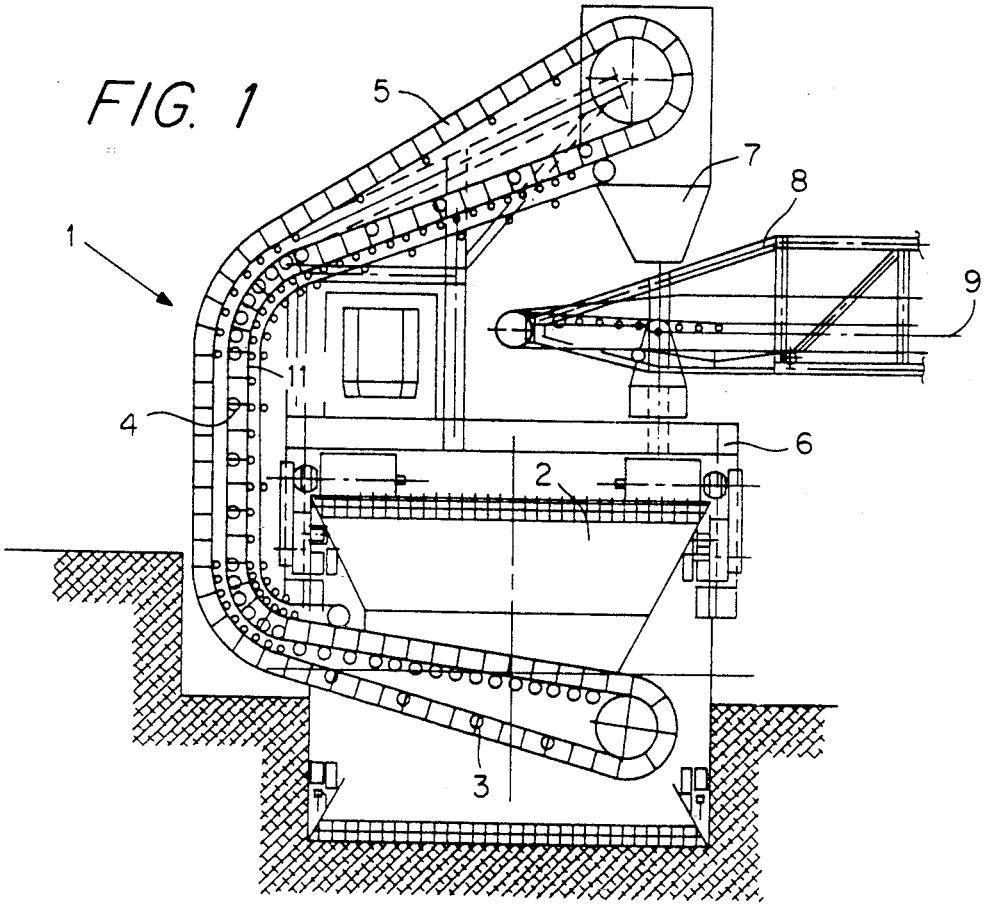
FIG. 1 is a section through the winning equipment employed with the strip-mining method.

The winning equipment 1 illustrated in FIG. 1 preferably travels on unillustrated caterpillar undercarriages. One such mechanism is positioned upstream and another downstream of a winning tool in the form of an excavating cylinder 2. The undercarriages are independently powered. They can be raised and lowered separately by hydraulically activated parallelograms.

The design of winning equipment 1 and excavating cylinder 2 are specified in German Patent Application P 3 920 011.6. The cylinder has teeth mounted in holders on horizontals.

The teeth extract the mineral. The horizontals and baffles convey the extracted mineral inside the cylinder through a stationary annular aperture and chute. It is then deposited onto an out-take conveyor 3, 4, and 5.

The out-take conveyor is a continuous belt in three sections. An initial section 3 extends axially out of excavating cylinder 2. A middle section 4 extends vertically up to approximately the upper edge of the equipment's chassis 6. The terminal section 5 of the conveyor slopes up at a slight angle to a transfer point 7 above chassis 6.

At transfer point 7, out-take conveyor 3, 4, and 5 deposits the mineral onto a carry-off conveyor 9 accommodated in a boom 8.

Figure 2:
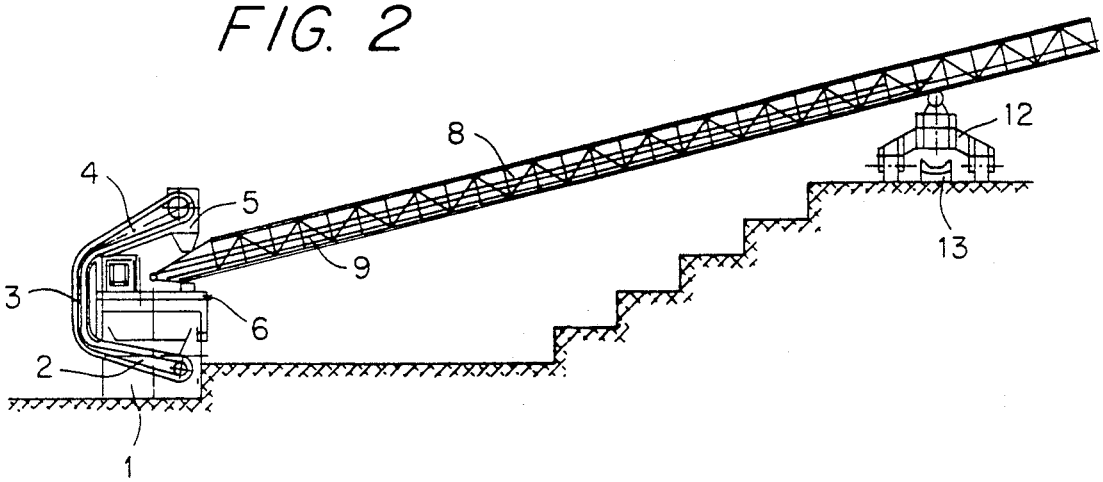
FIG. 2 is a side view of the equipment illustrated in FIG. 1 in operation in conjunction with a boom and loader.

FIG. 2 illustrates winning equipment 1 operating in a pit with means of further conveyance. Boom 8 is attached to winning equipment 1 at transfer point 7. The boom pivots freely around a horizontal articulation perpendicular to its length. Carry-off conveyor 9 consists of a continuous webbed belt accommodated in boom 8.

The end of boom 8 remote from transfer point 7 is fastened to a loader 12 with three degrees of freedom. The boom also slides back and forth along its length on the loader. Loader 12 can travel on caterpillar treads for example.

Under loader 12 is a face conveyor 13 in the form of a webbed belt.

Figure 3:
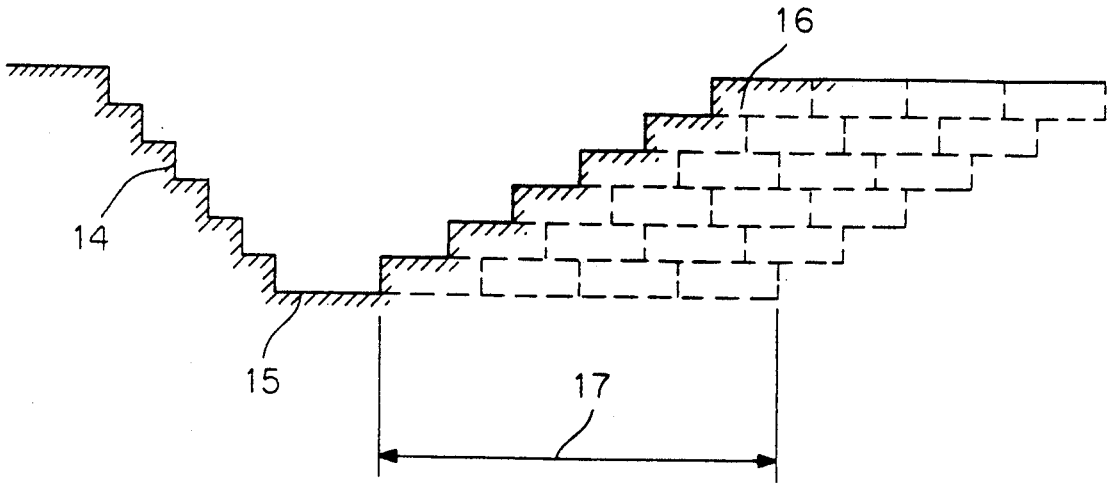
FIG. 3 is a vertical section through a pit, indicating the incision geometry.
Figure 3A:
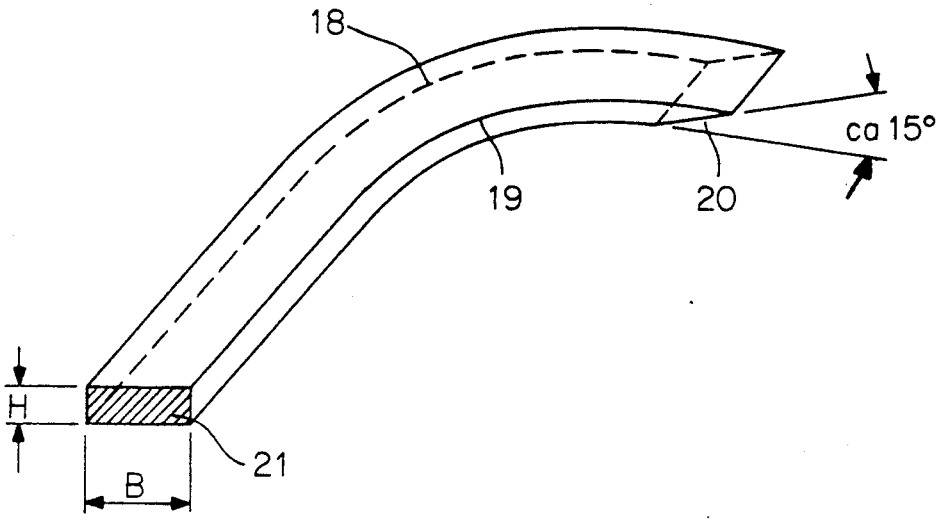
FIG. 3*a* is a perspective view of a removed strip of mineral from the pit of FIG. 3.

The bottom of FIG. 3 illustrates the geometry of the pit. The pit has a terraced wall 14, a floor 15, and a block 16 of mineral. The block has a width 17.

Wall 14 is created by removing strips 18 of mineral in parallel demarches.

At the top of FIG. 3 is a perspective view of an extracted strip 18. The strip curves along the arc 19 of one fourth of a circle. It merges into a ramp surface 20 that slopes up approximately 15°. Strip 18 has a rectangular cross-section 21.

FIG. 4 is a perspective view of part of the strip-mining district subsequent to the establishment of floor 15. The view shows terraced wall 14, which has an overall slope 22 of approximately 50°. The combined ramp surface 20 at the end of the pit (downstream of the quarter-circle arc) slopes approximately 15°. Indicated on the right side of the figure is face conveyor 13 before and after being shifted one width 23 to the side.

Figure 5:
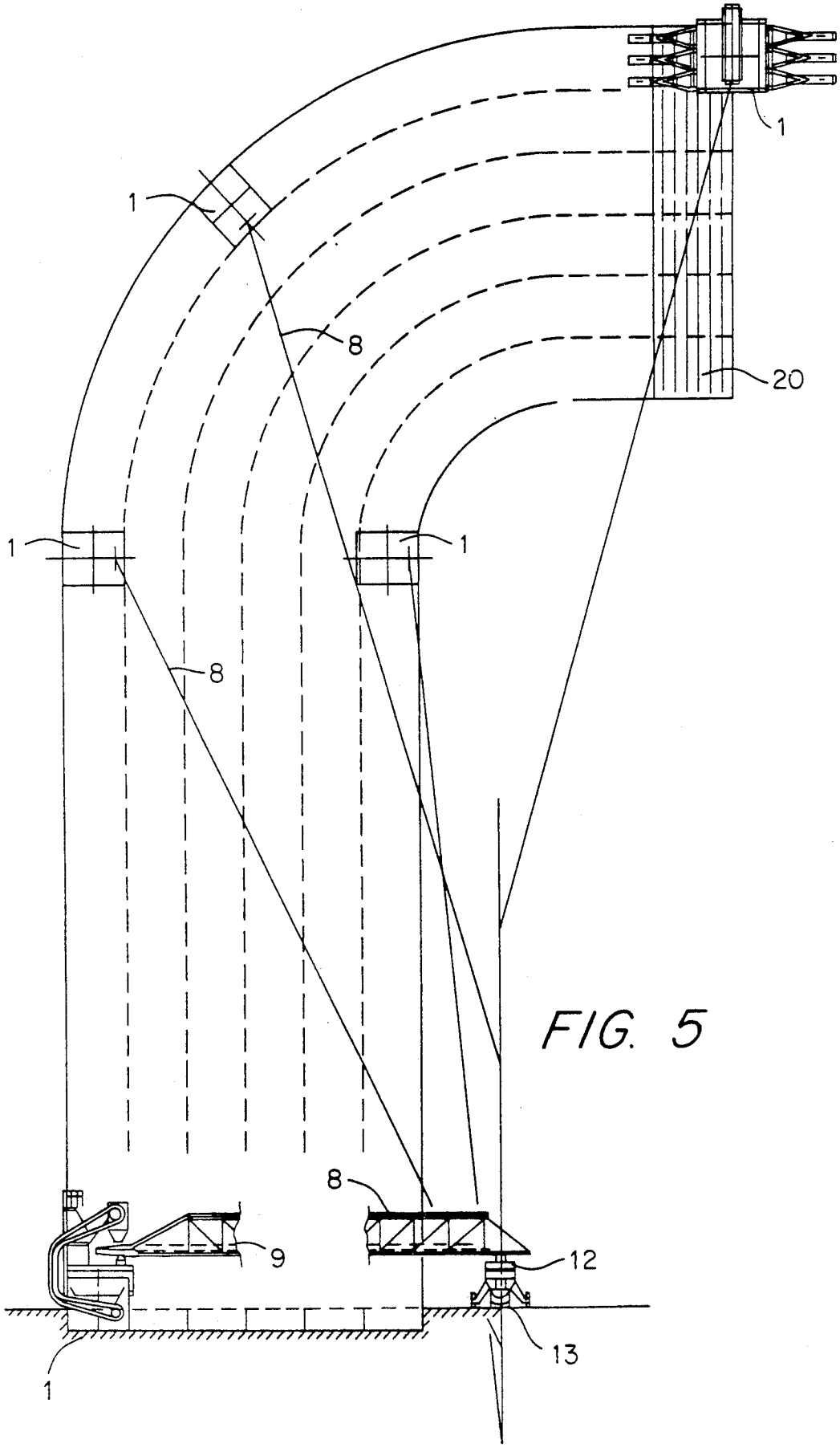
FIG. 5 is a schematic overhead view of a strip-mining procedure at its commencement.

FIG. 5 is a schematic representation of the strip-mining method in accordance with the invention in a portion of the district. At the bottom edge of FIG. 5 is a side view of winning equipment 1, connecting boom 8, loader 12, and face conveyor 13. They are illustrated at the commencement of the mining procedure, while, that is, the uppermost strip 18 is being removed.

Figure 6:
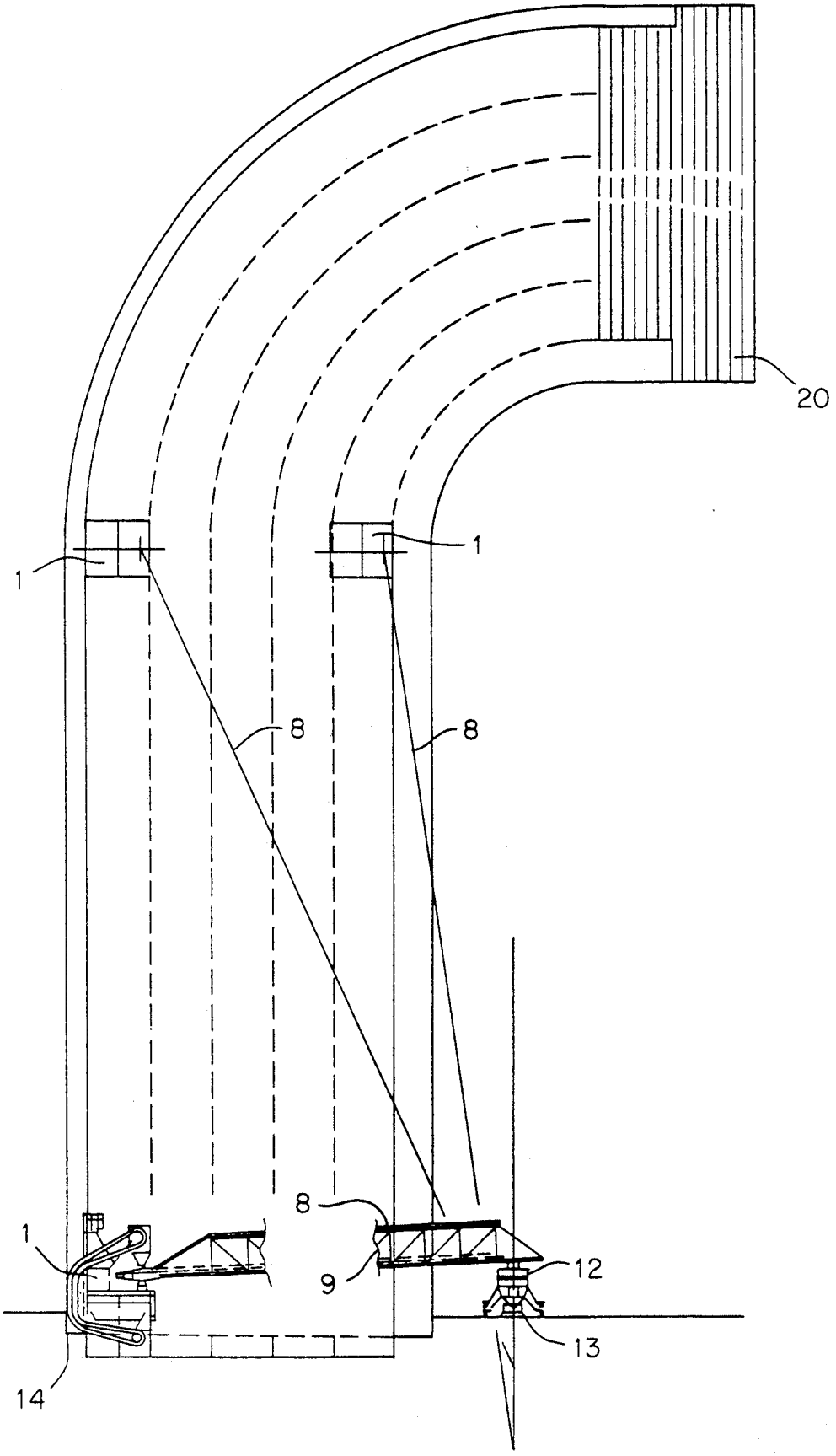
FIG. 6 is a schematic representation of a later stage in the strip-mining procedure illustrated in FIG. 5.

FIG. 6 is intended to represent a later stage of strip mining. The view at the bottom indicates that winning equipment 1 is operating on the next lowest level. Loader 12 and face conveyor 13 are still in the position they were in at the commencement of the procedure (FIG. 5). The face conveyor has not as yet been shifted to the side.

Figure 7:
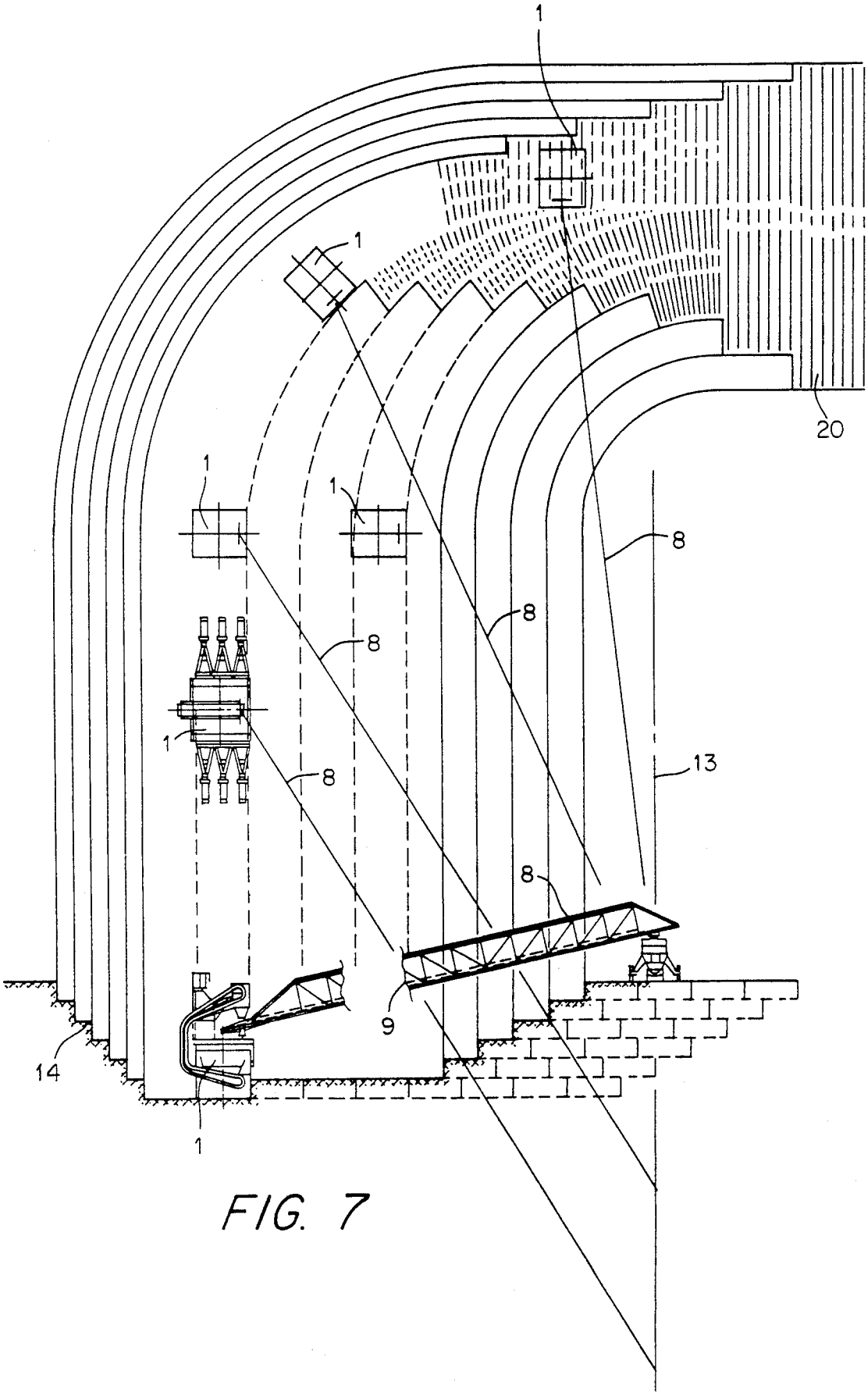
FIG. 7 is a schematic representation of the strip-mining procedure illustrated in FIGS. 5 and 6 prior to excavation of the spoils.

FIG. 7, finally, illustrates the situation at an even later stage, just before the mineral in one block 16 has been removed. Winning equipment 1 is removing lowest strip 18. Apparent at one side of the equipment is a steep wall 14. Face conveyor 13 has been shifted to one side in accordance with the advanced stage of the operation. A combined ramp surface 20 has come into existence within fourth-of-a-circle arc 19. Winning equipment 1 is traveling over the ramp before returning to the district in the opposite direction.

Figure 8:
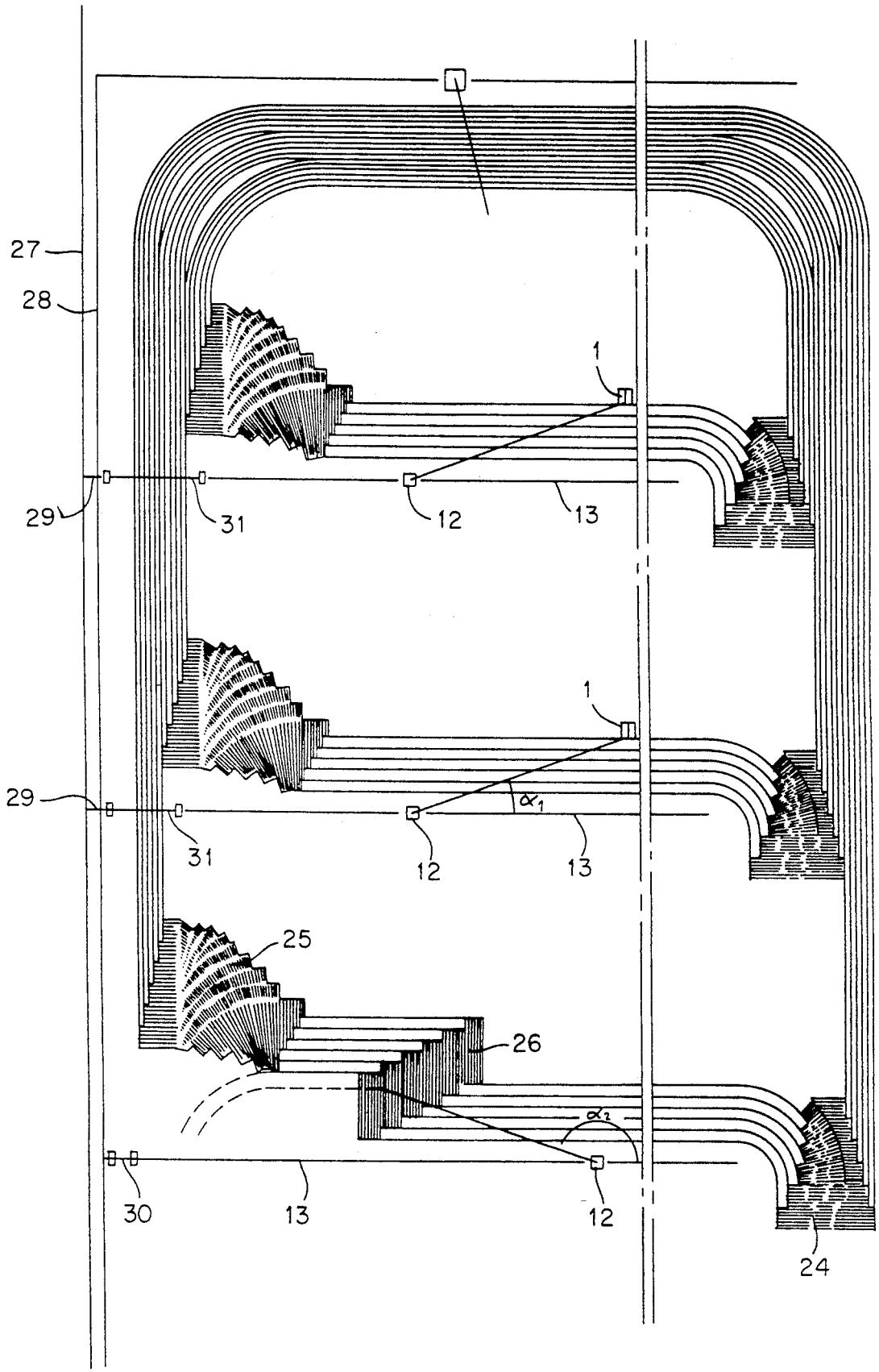
FIG. 8 is an illustration of the pit representing the situations according to the present invention.

FIG. 8 illustrates situations in which the angle between the out-take conveyor 5 on winning equipment 1 and the carry-off conveyor 9 in connecting boom 8 must be no more than ±90°. A collecting conveyor belt 27 is to be positioned at the very edge of the pit. For these reasons it is practical to divide the overall length of block 16 in two.

Face conveyor 13 is shifted to the side. Block 16 is mined from terminal ramp 24 to intermediate ramp 26. Connecting boom 8 is at an angle $\alpha_1$, less than 90°, to face conveyor 13. The direction of connecting boom 8 is altered to an angle $\alpha_2$, more than 90°, to face conveyor 13. The rest of block 16 is now mined from intermediate ramp 26 to the other terminal ramp 25.

The procedure has three objectives:

1.

It prevents collecting conveyor belt 27 having to be positioned the length of one connecting boom 8 farther away from the edge of the pit, which would necessitate occupation of another corresponding margin of ground for the strip-mining procedure.

2.

It avoids having to make face conveyor 13 one beam-length longer then necessary.

3.

It eliminates the need for a wider pivoting angle between winning equipment 1 and connecting boom 8.

This could only be attained by accepting even more disadvantages.

Since no mineral is being conveyed by carry-off conveyor 9 while connecting boom 8 is pivoting from angle $\alpha_1$ to angle $\alpha_2$, connecting boom 8 can also be supported at the loader end over a displacement that is longer than during conveyor operation, when the flow of material from the beam must arrive in the hopper of loader 12.

The controls that force loader 12 to accompany the shifts executed by connecting boom 8 within narrow tolerances during normal mining operations will accordingly be disengaged during the pivoting process in accordance with the invention.

Connecting boom 8 can shift +0.5 to +1 meter for example over loader 12 during mining operations and pivot approximately $\frac{1}{3}$ to $\frac{1}{2}$ of the length of the boom.

It is practical to shift the face conveyors 13 in a known way with an unillustrated crabbing tractor once one block 16 has been removed. The tractor can have a roller head. It will lift a rail secured to horizontals on the belt's supporting framework and apply lateral traction to the framework during every advance of one belt length, shifting it approximately 1 meter to the side.

The face conveyor 13 on the uppermost block 16 of mineral will in a practical way accommodate a mobile or partly mobile drive station 30 at the head with provision for transferring onto one or two collecting conveyor belts. The system may include two collecting belts 27 and 28, one for product and one for spoil. In this event, it will be practical for drive station 30 to have a distributor or inverted-Y chute 29.

It will be practical for face conveyors associated with deeper layers to transfer onto an upright traveling conveyor boom 31. A device of this type can travel on caterpillar treads at the same level as the face conveyor and on other caterpillar treads at the same level as the collecting belt. When two collecting belts are employed, it will be practical for upright boom 31 to have a distributor or inverted-Y chute 29 at the output end.

I claim:

1. A method for strip-mining coal or other minerals by continuous-operation winning means, comprising the steps of: providing said winning means with a cylindrical winning tool with a diameter; excavating by said tool strips with a substantially rectangular section with a rectangle having a width substantially as wide as the tool and having a height less than half the tool's diameter as said winning means advances; providing conveyor belts connecting said winning means to a loader;

depositing with said loader excavated minerals onto a face conveyor that is shiftable substantially parallel to a direction of motion of said winning means; exposing a quadrilateral district by moving said winning means first along one short side thereof, then along one side thereof, and finally along the other short side thereof; lifting out with said tool a strip of mineral and turning at each end along an arc of substantially one eighth to one fourth of a circle to end up in a ramp surface occurring when the tool is lowered and raised; lifting out a plurality of strips while shifting movement of said winning means to a side for producing a terraced wall; combining ramps of various strips into one ramp surface with a slope allowing said winning means to travel over said ramp surface under its own power; mining in succession blocks of mineral in the district after said terraced wall has been produced, said district comprising a plurality of levels one above another and one adjacent to another, said mining step starting with a floor produced along with said wall, each level comprising an equal number of adjacent strips.

2. A method as defined in claim 1, wherein another block is removed after one block of mineral in the district has been mined and aid face conveyor has been shifted one block width to a side.

3. A method as defined in claim 1, wherein ends of all strips comprise a com'ination ramp surface after one block of mineral has been mined; moving said winning means over said combination ramp surface and forming a similar combination ramp surface shifted in width by one free-conveyor shift to a side after the next and each subsequent block has been mined.

4. A method as defined in claim 1, wherein each block of mineral is mined in a first section and a second section, the first section extending from one terminal ramp to any point along a length of said first section and the second section extending from said point to another terminal ramp to form an intermediate ramp; moving said winning means over said intermediate ramp, ramp surfaces of all the strips being adjacent end to end and side to side, said winning means being connected to a boom changing direction as viewed from above during transition from the first section to the second section, so that the boom extends along an associated radius of two eighth- to fourth-of-a-circle terminal ramps.

5. A method as defined in claim 1, including the step of providing upright traveling conveyor booms extending from the face conveyors to at least one collecting conveyor belt on an edge of a pit being mined.

6. A method as define din claim 1, including the step of providing upright traveling conveyor booms extending from the face conveyors to at least a plurality of collecting conveyor belts on an edge of a pit being mined, each upright traveling conveyor boom having a distributor.

7. A method as defined in claim 1, including the step of providing upright traveling conveyor booms extending from the face conveyors to a plurality of collecting conveyor belts on an edge of a pit being mined, each upright traveling conveyor boom having an inverted-Y chute.

* * * * *